US009631403B2

(12) United States Patent
Beck

(10) Patent No.: US 9,631,403 B2
(45) Date of Patent: Apr. 25, 2017

(54) ACTUATION DEVICE FOR A FLAP

(75) Inventor: Christian Beck, Roettingen (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 379 days.

(21) Appl. No.: 14/118,488

(22) PCT Filed: May 17, 2012

(86) PCT No.: PCT/US2012/038350

§ 371 (c)(1),
(2), (4) Date: Nov. 18, 2013

(87) PCT Pub. No.: WO2012/158916

PCT Pub. Date: Nov. 22, 2012

(65) Prior Publication Data

US 2014/0084599 A1 Mar. 27, 2014

(30) Foreign Application Priority Data

May 17, 2011 (DE) ..... 10 2011 101 838

(51) Int. Cl.

| | |
|---|---|
| ***E05C 5/04*** | (2006.01) |
| ***E05B 83/34*** | (2014.01) |
| ***E05C 19/02*** | (2006.01) |
| *E05C 5/02* | (2006.01) |

(52) U.S. Cl.

CPC ..... *E05B 83/34* (2013.01); *E05C 19/022* (2013.01); *E05Y 2201/22* (2013.01); *E05Y 2201/232* (2013.01); *E05Y 2201/426* (2013.01); *E05Y 2201/474* (2013.01); *E05Y 2800/11* (2013.01); *Y10T 292/0864* (2015.04)

(58) Field of Classification Search

CPC ..... E05B 83/34; E05C 19/02; E05C 19/022; E05C 19/028; E05Y 2201/22;

(Continued)

(56) References Cited

U.S. PATENT DOCUMENTS

| | | | |
|---|---|---|---|
| 3,854,785 | A | 12/1974 | Manner et al. |
| 5,292,158 | A | 3/1994 | Kurosaki |

(Continued)

FOREIGN PATENT DOCUMENTS

| | | | |
|---|---|---|---|
| CN | 1699720 | A | 11/2005 |
| CN | 1749920 | A | 3/2006 |

(Continued)

OTHER PUBLICATIONS

ISR for International Application No. PCT/US2012/038350 mailed Oct. 2, 2012.

*Primary Examiner* — Alyson M Merlino
(74) *Attorney, Agent, or Firm* — Hauptman Ham, LLP

(57) ABSTRACT

An actuation device for a flap mounted pivotably on a compartment, with a push-push kinematic, includes a first actuation part to be fastened on the flap and a second actuation part to be fastened on the component. The first actuation part engages with the second actuation part when the flap is moved from its opened position into its closed position, so that after a first stroke of the first actuation part in the direction of the second actuation part and a subsequent backstroke of the first actuation part, the actuation parts are held on each other in an arresting position. The arresting position is released by a second stroke of the first actuation part in the direction of the second actuation part so that the flap can be moved into its opened position, wherein the first actuation part and the second actuation part are disengaged.

17 Claims, 3 Drawing Sheets

(58) Field of Classification Search
CPC ..... E05Y 2201/232; E05Y 2201/426; E05Y 2201/474; E05Y 2800/11
USPC ..... 296/97.22; 292/57, 58, 137, 163, 164, 292/170, 169, 169.13, 169.14, 175, 138, 292/140, 145, 146, 150, 332, 335, DIG. 4, 292/DIG. 37, 59–64, 67–69; 74/110; 312/319.2; 49/326
See application file for complete search history.

(56) References Cited

U.S. PATENT DOCUMENTS

| | | | | |
|---|---|---|---|---|
| 6,702,357 | B2 * | 3/2004 | Joerg | B60K 15/05 220/86.2 |
| 2006/0057879 | A1 | 3/2006 | DeLuga et al. | |
| 2006/0103148 | A1 | 5/2006 | Rechberg | |
| 2009/0139991 | A1 | 6/2009 | Nakaya | |
| 2011/0309637 | A1 | 12/2011 | Beck | |

FOREIGN PATENT DOCUMENTS

| | | | | |
|---|---|---|---|---|
| DE | 3149635 | A1 | 6/1983 | |
| DE | WO 2010058304 | A1 * | 5/2010 | B60K 15/05 |
| DE | 102008057933 | A1 * | 7/2010 | B60K 15/05 |
| DE | 102009008496 | A1 | 8/2010 | |
| EP | 1281558 | A2 | 2/2003 | |
| FR | 2800018 | A1 | 4/2001 | |
| JP | 2007290573 | A | 11/2007 | |
| JP | WO 2012117839 | A1 * | 9/2012 | B60K 15/05 |
| WO | 2011081926 | A1 | 7/2011 | |

* cited by examiner

ACTUATION DEVICE FOR A FLAP

TECHNICAL FIELD

The invention relates to an actuation device for a flap mounted movably on a component between a closed position and an opened position with a push-push kinematic, in particular for a flap in or on an automobile mounted pivotably on a compartment.

BACKGROUND ART

It is known for filler-neck flaps, for example, of automobiles to be actuated by means of so-called push-push devices. A corresponding actuation device is known for example from DE 10 2008 057 933 A1. The actuation device is fastened on the filler-neck compartment, wherein said actuation device has an actuation end which projects out of the compartment in the installed state. The known actuation device has an axially movably mounted tappet which has a control curve on its outer circumference. The actuation device furthermore has a housing and a ring mounted axially fixed and rotatable in the housing, which ring has at least one projection on its inner circumference. During operation, the filler-neck flap interacts with the actuation end, which projects out of the compartment, of the actuation device. In particular, in the closed state, the filler-neck flap rests with its inner side on the actuation end. Owing to the push-push kinematic, the actuation device can, by virtue of the filler-neck flap being pressed in the direction of the automobile body, be moved into an unlocking position in which the actuation end protrudes further out of the filler-neck compartment and the filler-neck flap rises slightly from the body surface. The filler-neck flap can then be manually gripped and fully pivoted open. During a subsequent closure of the flap, and when a force is exerted here on the actuation end of the actuation device, said actuation device is placed into a locking position again.

In order that the filler-neck flap cannot unintentionally pivot open when in the locking position, it is preloaded into the closed position by a spring. Forces act on the filler-neck flap during operation of the vehicle but also as early as during the assembly process. Examples here are situations in which the vehicle is assembled in a pivoted or overhead position, in which the force of gravity acts on the filler-neck flap in the opening direction of the flap. Another example is car washes, where an exertion of force in the opening direction of the flap may likewise arise in particular during the drying process. An unintentional opening of the filler-neck flap must be reliably prevented in these situations. The spring which preloads the filler-neck flap into the closed position must therefore exert a relatively high spring force. In the case of assembly in a pivoted position, this is applicable in particular to filler-neck flaps composed of a metal material. Said relatively high spring force must be overcome by a user during the opening of the flap. This can reduce convenience. Furthermore, with the relatively high spring forces, undesired noise generation can arise during the actuation.

Furthermore, it is often sought to couple filler-neck flaps to the central locking device of an automobile, such that when the automobile is locked, the filler-neck flap cannot be opened. Since it is the case in the known device that the filler-neck flap is held in the closed position only by a spring force, relatively complex additional measures are required for this purpose.

SUMMARY

Taking the explained prior art as a starting point, it is the object of the invention to provide an actuation device of the type specified in the introduction which is characterized firstly by a simple and robust construction, in particular permits simple integration into a central locking device of an automobile, and secondly permits increased operating convenience.

The invention achieves said object by means of the subject matter of claim 1. Advantageous refinements emerge from the dependent claims, the description and the figures.

The invention achieves the object by means of an actuation device for a flap mounted movably on a component between a closed position and an opened position, in particular for a flap in or on an automobile mounted pivotably on a compartment, with a push-push kinematic, comprising:

- a first actuation part and a second actuation part, wherein the first actuation part is to be fastened on the flap and is moved in an axial direction when the flap is moved between the closed position and the opened position, and wherein the second actuation part is to be fastened on the component,
- wherein the first actuation part engages with the second actuation part when the flap is moved from its opened position into its closed position, so that after a predetermined first stroke of the first actuation part in the direction of the second actuation part and a subsequent backstroke of the first actuation part, the actuation parts are held on each other in an arresting position, and
- wherein the arresting position is released by a predetermined second stroke of the first actuation part in the direction of the second actuation part so that the flap can be moved into its opened position, wherein the first actuation part and the second actuation part are disengaged.

The flap may be a flap in or on an automobile. The flap may be for example a filler-neck flap or charging flap of an automobile, said flap being mounted in a movable, in particular pivotable manner on a filler-neck compartment or charging compartment of the automobile. When the filler-neck flap or charging flap is in the opened position, a fuel tank of the automobile can be filled with fuel, or electrical drive components of the automobile can be electrically charged. Other applications in the automotive field or also outside the automotive field are however also conceivable. Examples of these are flaps for glove compartments of automobiles or flaps in household applications, for example in kitchens or the like.

The actuation device comprises two actuation parts. According to the invention, the first actuation part is fastened on the flap and is moved together with the flap when the flap is moved. According to the invention, the second actuation part is fastened on the component which is for example arranged fixedly in or on an automobile. According to the invention, the first actuation part and the second actuation part are thus separate from one another. Because the second actuation part does not move during a movement of the flap, it is the case according to the invention that, when the flap is moved, a relative movement between the first actuation part and the second actuation part occurs. When the flap is moved, the first actuation part is in particular at least also moved in the axial direction. Here, the first actuation part may also be moved in other directions. For example, in the case of a pivoting movement of the flap, the first actuation part may likewise perform a pivoting movement. The movement of said first actuation part however also has an axial component here, such that the first actuation part can be placed in engagement with the second actuation part in the axial direction.

As already mentioned, according to the invention, the first and second actuation parts, which in the prior art form a structural unit and which realize the push-push kinematic according to the invention, are formed separate from one another. As the push-push cycle is run through, the actuation parts can be placed into an arresting position. According to the invention, in said arresting position, the flap fixedly connected to the first actuation part is thus also arrested on said component which serves to movably mount said flap. An opening of the flap by a force acting in the opening direction of the flap, for example in the case of assembly in a pivoted position or during the course of drying in a car wash, therefore cannot open the flap when the actuation parts are in the arresting position. Moreover, to open the flap, the arresting position must firstly be released by virtue of the first actuation part being moved further in the direction of the second actuation part. After the release of the arresting position, the actuation parts can also be released from one another. In particular, the flap can then be opened, wherein the first actuation part together with the flap is removed from the second actuation part.

According to the invention, in contrast to the prior art, the flap is thus arrested on the component in the arresting position. In this way, an unintentional opening of the flap, for example in a car wash or during assembly in a pivoted or overhead position, is reliably prevented. In particular, it is not necessary to impart such a high spring force that the flap is held in the closed position solely by the spring force even in such situations. In this way, convenience during the use of the flap is increased. Also, the noises generated by the high spring forces of the prior art, which noises are perceived by a user as unpleasant, are eliminated. It may self-evidently also be provided with the invention that the flap is preloaded into the closed position by spring force. The corresponding spring force is however substantially freely selectable and may in particular be considerably lower than in the prior art. In a manner which is likewise known per se, the spring force may have a reversal point, such that beyond a certain degree of opening or opening angle, the flap is preloaded into the open position.

According to the invention, particularly secure arresting in the arresting position is attained. At the same time, a high sealing action against an ingress of moisture or dirt is attained in the closed position and the opened position of the flap. Corresponding sealing devices, for example sealing lips, may be provided for this purpose. At the same time, the actuation device according to the invention is characterized by a robust and simple design with a small number of components. It has a small structural size and is therefore also suitable for use in relatively small compartments, for example filler-neck compartments or charging compartments. As a result of its modular design, the actuation device can be flexibly adapted within wide limits to the respective requirements. The essential constituents of the actuation device, in particular the actuation parts, may be composed of plastic and produced for example in a plastic injection molding process. The actuation device according to the invention can also be used in self-opening flap systems.

The actuating device may comprise spring means which are preloaded by the first actuation part upon the first predetermined stroke, wherein the spring means automatically effect the subsequent backstroke of the first actuation part. The spring means are thus preloaded during the course of the first stroke. The spring means may self-evidently also be preloaded before the first stroke. As a result of the preload, after the actuation part which has been moved with the first stroke is released, said actuation part is automatically placed, with the backstroke, into the arresting position. A second predetermined stroke, which is performed during the course of a subsequent release of the arresting position, again takes place counter to the spring force, such that the spring means are preloaded again and can subsequently, with a further backstroke, place the first actuation part out of engagement with the second actuation part. In said position, the flap may for example be fully opened manually. Since, according to the invention, the arresting of the flap on the component is realized by the actuation device, both the locking force to be imparted counter to the spring means and the deployment stroke force of the tappet imparted by the spring means and also the unlocking force can be substantially freely selected.

In a further refinement, it may be provided that one of the actuation parts comprises a tappet with a control curve on its outer circumference, and that the other of the actuation parts comprises a housing and a control ring mounted axially fixed and rotatable in the housing, wherein the control ring comprises at least one control projection on its inner circumference, wherein the tappet enters the control ring when the flap is moved from its opened position to its closed position, wherein the at least one control projection of the control ring engages with the control curve of the tappet so that after the predetermined first stroke and the subsequent backstroke the tappet is held in the arresting position on the control ring, and wherein the tappet is released from the arresting position on the control ring by the second predetermined stroke, so that the flap can be moved into its opened position, wherein the tappet exits the control ring, so that the at least one control projection of the control ring and the control curve of the tappet disengage.

Such a refinement leads to a particularly robust push-push kinematic. In particular, there is no requirement for control springs or the like, which are sensitive and susceptible to failure during operation, and which engage with a control curve. During the course of the engagement of the control projection and control curve as the push-push cycle is run through, the control ring is rotated by the tappet which is moved into said control ring. Here, the tappet may enter into the housing upon passing through the control ring, and may emerge from the housing again upon emerging from the control ring. The housing may have a housing body and a housing cover, wherein the control ring may be mounted between the cover and the housing body. In a manner known per se, the housing may comprise a detent device by means of which said housing can be locked to the flap or to the component for assembly. Such a locking connection is known for example from DE 10 2009 008 496 A1.

It is possible both for the first actuation part to have the tappet and for the second actuation part to have the housing and the control ring mounted axially fixed and rotatable in the housing, and also for the first actuation part to have the housing and for the second actuation part to have the tappet. The tappet may thus be fastened both on the flap and also on the component. Accordingly, the housing and the control ring may be fastened both on the component and also on the flap.

In a further refinement, it may be provided that the control curve of the tappet comprises:

at least one axially parallel groove on the outside of the tappet, wherein the control projection of the control ring is engageable with the groove over a large axial adjusting range of the tappet, whereby the control ring keeps its rotational position in the area of the groove when the tappet is moved axially, a first deflection surface between the groove and a proximal end of the tappet which is facing away from the control ring before entering the control ring, which first deflection surface is inclined to the axis of the tappet, wherein the deflection surface engages with the control projection of the control ring and rotates the control ring about a predetermined angular value when the tappet is moved into the control ring with the predetermined first stroke, a locking reception, in a circumferential distance to the first deflection surface and facing towards the proximal end of the tappet, wherein the locking reception receives the control projection when the tappet carries out a backstroke, whereby the tappet is held in the arresting position in the control ring after the backstroke, a second deflection surface between the locking reception and the proximal end of the tappet, which second deflection surface is inclined to the axis of the tappet, wherein the second deflection surface engages with the control projection when the tappet is moved further into the control ring with the second stroke from the arresting position, whereby the control ring is rotated by a predetermined second angular value and the control projection is aligned with a second axial groove on the outer circumference of the tappet and the tappet is moveable into its furthest extended position.

Here, the proximal end of the tappet is that end which faces away from the free (distal) end which protrudes into the control ring first during operation. Such a control curve and a corresponding interaction of at least one control projection of a control ring with the control curve are known in principle from DE 10 2008 057 933 A1 mentioned in the introduction. Said embodiment of the push-push kinematic has proven to be particularly robust and minimally susceptible to failure in practice.

In a further refinement, the tappet may be surrounded on its circumference by a sealing, in particular by a bellows. The sealing may be elastic. The sealing may in particular surround the tappet about the entire circumference thereof. The sealing seals off the tappet with respect to dirt and moisture. Said sealing also automatically serves to protect the housing and the control ring mounted therein from dirt and moisture when the tappet enters into the control ring or the housing. At the free end of the tappet, the sealing may be fastened sealingly on the tappet. The same applies to that end of the tappet which is situated opposite the free end. For example, at said end, the tappet may be mounted on the sealing elastically in an axial direction. The sealing may for this purpose for example receive a flange of the tappet. The elastic mounting may be realized by the resiliently elastic form of the sealing. Such elastic mounting serves to realize tolerance compensation during the assembly of the actuation device.

The actuation device according to the invention may furthermore comprise locking means which are adjustable between a locking position and an unlocking position, wherein in the locking position releasing the arresting position of the actuation parts is not possible, and wherein in the unlocking position releasing the arresting position of the actuation parts is possible. In a further refinement, the locking means may be actuated between the locking position and the unlocking position by a central locking device of an automobile. It is also possible that, in the locking position, the locking means impede the predetermined second stroke of the first actuation part. By contrast, in the unlocking position, the locking means permit the second stroke of the first actuation part.

Since, according to the invention, one of the actuation parts is fastened on the flap and one of the actuation parts is fastened on the component, it is particularly advantageously possible, by contrast to the prior art, for an opening of the flap to be impeded through prevention of the release of the arresting position. As a result, it is in turn possible for the locking means to be realized in a considerably simpler manner, and using considerably fewer parts, in relation to the prior art. The integration of the actuation device according to the invention into a central locking device of an automobile is thereby likewise considerably simplified. It is additionally possible for manual unlocking means to be provided in order to place the locking means into the unlocking position, for example if a battery of the automobile has been completely discharged. Such manual unlocking means may for example comprise a manually actuable strap which places the locking means into the unlocking position.

In a further refinement, it may be provided that the locking means comprise drive means and at least one locking element which is moveable by the drive means in a radial direction with respect to the axial moving direction of the first actuation part between a locking position and an unlocking position, wherein in the locking position the locking element engages with the first actuation part or with the second actuation part and thus impedes the predetermined second stroke of the first actuation part. This forms a particularly practical and structurally simple and also robust embodiment of the locking means, which is made possible owing to the separation, according to the invention, of the actuation parts of the actuation device. In said embodiment, the locking element is moved in particular in the radial direction relative to the for example cylindrical tappet. The locking element can engage in a positively locking manner with the first or second actuation part. In the locking position, the locking projection can impede an axial movement of the first actuation part only in the axial direction required for performing the second stroke, or in both axial directions. The drive means may comprise electric drive means and for example an electric motor. The electrical supply may for example be realized via a plug contact (also a customer-specific plug contact) which may be formed for example on the housing of the corresponding actuation part. It is however also conceivable to provide a cable connection for the electrical supply. The electrical supply may be realized in particular via the on-board electrical system of an automobile.

In a further refinement, the first or second actuation part may comprise a reception, wherein in the locking position the locking element engages in the reception and in the unlocking position is retracted from the reception. The reception may for example be formed on the outer circumference of the tappet. The locking element may be a locking projection or a locking lug. The locking element may for example be in the form of a locking fork. It may for example have a C-shaped cross section which, in the locking position, engages into the corresponding reception. If the locking element is situated in the reception, at least one axial movement of the first actuation part, for example of the tappet, caused by the predetermined second stroke is impeded. If, by contrast, the locking element is retracted out of the reception, an axial movement of the first actuation part, for example of the tappet, caused by the predetermined second stroke is permitted. It is advantageous in this refinement that the locking forces need not be transmitted via the control ring. Said control ring is thus subjected to lower loads.

In a further refinement, it may be provided that the actuation part comprising the control ring further comprises a bolt which is mounted axially moveable in the housing and which is preloaded by a spring in the direction of the control ring, wherein the tappet pushes the bolt against the spring upon the predetermined first stroke and preloads the same thereby, wherein the spring automatically effects the subsequent backstroke of the first actuation part. Again, the spring may self-evidently also already have a preload before the first stroke. The control ring may for example be mounted in the region of an opening, which faces toward the tappet, of the housing. The bolt is arranged in the housing on that side of the control ring which faces away from the tappet. Said bolt may be arranged between the control ring at one side and the spring at the other side. The tappet, upon passing through the control ring, thus comes into contact with the bolt and pushes the latter away from the control ring counter to the spring force of the spring. It is then furthermore possible for the reception into which the locking element of the locking means engages to be formed on the outer circumference of the bolt. In the same way as explained above with regard to the reception in the tappet, the locking and unlocking can be effected in this way.

In a further particularly practical refinement, the reception into which the locking element of the locking means engages may be a reception groove, in particular a circumferential groove.

In a further refinement, the first actuation part can be fastened on the flap by a locking connection or a bayonet connection. Alternatively or in addition, the second actuation part can be fastened on the component by a locking connection or a bayonet connection. If a locking connection is provided, corresponding locking means may be provided on the first and/or second actuation part or on the flap and/or on the component. A combined bayonet and locking connection is also conceivable. In said refinements, the actuation device according to the invention can be mounted on the flap, or on the component which serves to pivotably mount said flap, in a particularly simple manner without additional components such as screws or the like. It is possible in particular for the fastening of the actuation parts to be realized exclusively by means of the respective locking and/or bayonet connection. If, in the actuation device, no locking means are provided which interact with a central locking system of an automobile, it is possible with this refinement for the actuation device to be mounted from the outside, wherein for the mounting process there is no need for accessibility to the rear side of the component which serves to mount the flap.

The invention also relates to a component with a flap mounted moveably on the component between a closed position and an open position, in particular a compartment of an automobile with a flap mounted moveably, in particular pivotably, on the compartment, comprising an actuation device according to the invention. Here, the first actuation part of the actuation device is fastened on the flap. The second actuation part of the actuation device is fastened on the component which serves to movably mount the flap. The flap in turn may be a flap in or on an automobile, or else outside an automobile, as explained in the introduction with regard to claim 1.

BRIEF DESCRIPTION OF THE DRAWINGS

Exemplary embodiments of the invention will be explained in more detail below on the basis of figures, in which, in each case schematically.

DETAILED DESCRIPTION

Figure 1:
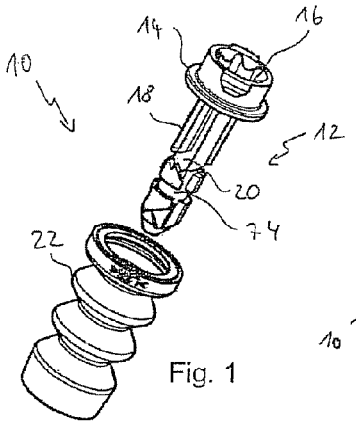
FIG. 1 shows a perspective exploded illustration 1 of a first actuation part of an actuation device according to the invention.
Figure 2:
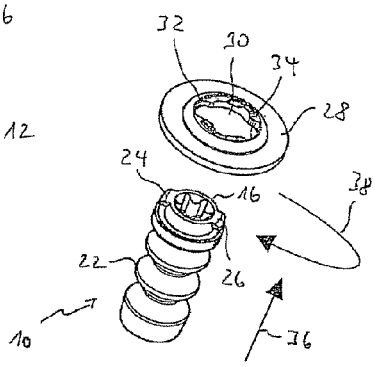
FIG. 2 shows a perspective view of the first actuation part from FIG. 1 in a pre-assembled state.
Figure 3:
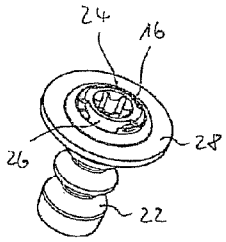
FIG. 3 shows a perspective view of the first actuation part from FIG. 1 in the assembled state.
Figure 4:
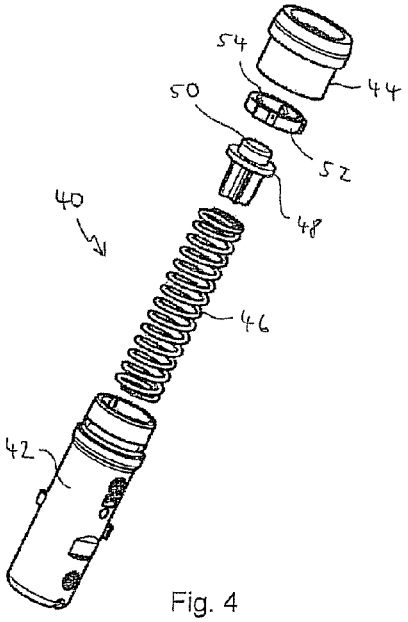
FIG. 4 shows a perspective exploded illustration of a second actuation part of an actuation device according to the invention as per a first exemplary embodiment.
Figure 5:
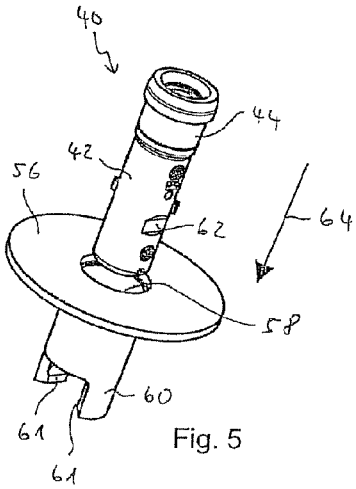
FIG. 5 shows a perspective view of the second actuation part from FIG. 4 in a pre-assembled state.
Figure 6:
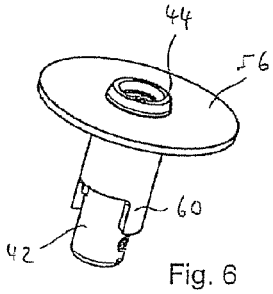
FIG. 6 shows a perspective illustration of the second actuation part from FIG. 4 in the assembled state.

Unless stated otherwise, the same reference numerals are used to denote identical objects in the figures. As can be seen from FIG. 1, the first actuation part 10 as per the first exemplary embodiment has a tappet 12 having a tappet head 16, which is provided with a flange 14, and having a substantially cylindrical tappet shank 18 which extends from the tappet head 16. On the outer circumference of the tappet shank 18 there is provided a control curve 20 for a push-push kinematic. The first actuation part 10 furthermore comprises an elastic sealing 22 in the form of an elastic bellows which, as can be seen in FIG. 2, is fastened on the tappet 12 so as to provide sealing, and in said state seals off the tappet shank 18 over the entire circumference thereof. FIG. 2 also shows that the tappet head 16 has two locking projections 24, 26 situated diametrically opposite one another. On the tappet shank 18 there is also formed an annularly encircling groove 74, the function of which will be explained in more detail on the basis of FIGS. 13 to 16. In particular when the tappet 12 interacts with the second actuation part 40, as shown in FIGS. 4 to 6, the provision of the groove 74 is not imperatively necessary. The first actuation part 10 shown in FIGS. 1 and 2 is, in the exemplary embodiment shown, fastened on a flap 28, in the present case a filler-neck flap 28, only a detail of which is shown in FIG. 2 for the sake of clear illustration. The filler-neck flap 28 has a hinge arm via which the filler-neck flap 28 is pivotably mounted on a filler-neck compartment of an automobile. The filler-neck flap 28 has an opening 30 which is circular in cross section and which has openings 32, 34 which correspond to the locking projections 24, 26. As shown in FIG. 2 by the arrow 36, in the rotational position shown in FIG. 2, the first actuation part 10 is inserted with the tappet head 16 into the opening 30 of the filler-neck flap 28. The first actuation part 10 is subsequently rotated, as shown in FIG. 2 by the arrow 38. In this way, the first actuation part 10 is fastened by means of its tappet head 16 on the filler-neck flap 28 in the manner of a bayonet connection. The assembled state is shown in FIG. 3.

FIG. 4 shows an exploded illustration of a second actuation part 40. Said second actuation part 40, together with the first actuation part 10 from FIGS. 1 to 3, forms an actuation device according to the invention as per a first exemplary embodiment. The second actuation part 40 has a housing, said housing having a housing body 42 which has a blind bore of circular cross section and having a housing cover 44 which is to be connected to the housing body 42 and which has a through bore likewise of circular cross section. An elastic spring 46 is arranged in the housing body 42. In the assembled state, the spring 46 is supported with one end thereof against the base, which is arranged at the bottom in FIG. 4, of the housing body 42. With its other end, the spring is supported on an underside of a flange 48 of an otherwise substantially cylindrical bolt 50. In the assembled state, a control ring 52 is provided axially fixed but rotatable between the top side of the flange 48 and a corresponding inner surface of the housing cover 44. The control ring 52 has, on its inner circumference, at least one control projection 54, in the exemplary embodiment shown a plurality of control projections 54. In the assembled state, shown in FIG. 5, of the parts of the second actuation part 40 illustrated in FIG. 4, the spring 46 in the housing body 42 is compressed, such that it preloads the bolt 50 in the direction of the upper opening of the housing cover 44. Furthermore, for the sake of a clear illustration, FIG. 5 shows only a detail of a filler-neck compartment 56 with a receiving opening 58 of circular cross section. In the example shown, two diametrically opposite locking legs 60 extend from the receiving opening 58. Said locking legs have in each case at least one locking projection 61 in the region of their free ends. The second actuation part 40 has, on the outer side of its housing body 42, locking recesses 62 assigned to the locking projections 61 of the locking legs 60. As shown by the arrow 64 in FIG. 5, the second actuation part 40 is inserted into the opening 58 of the filler-neck compartment 56, wherein locking of the locking projections 61 of the locking legs 60 in the associated locking recesses 62 of the housing body 42 occurs. The assembled state is shown in FIG. 6.

Both the first and also the second actuation part 10, 40 can thus be assembled in a particularly simple manner, without additional components, by means of the provided locking and bayonet connections.

Figure 7:
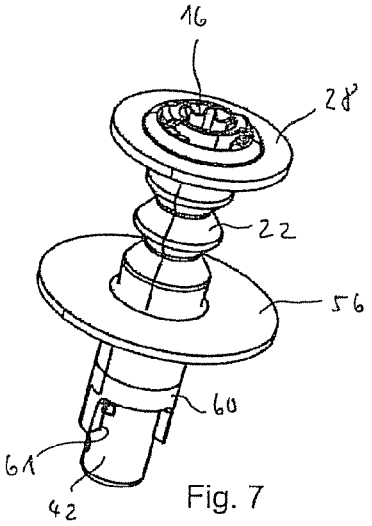
FIG. 7 shows a perspective view of an actuation device according to the invention with the first and second actuation parts from FIGS. 1 to 6 in a first operating state.
Figure 8:
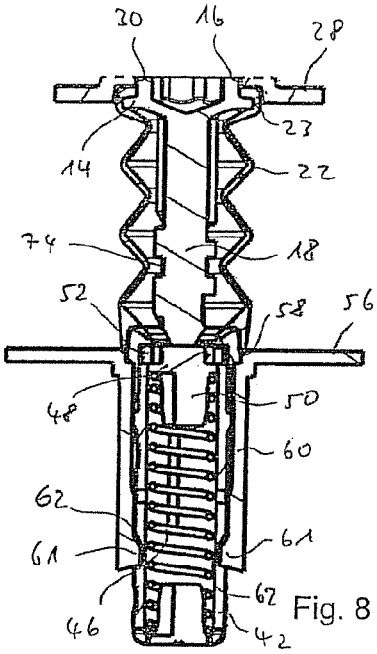
FIG. 8 shows a sectional view of the actuation device from FIG. 7.

The function of the actuation device according to the invention as per the first exemplary embodiment shall now be explained in more detail on the basis of FIGS. 7 to 12. Here, FIGS. 7 and 8 show a first operating state of the actuation device according to the invention having the first actuation part 10 from FIGS. 1 to 3 and the second actuation part 40 from FIGS. 4 to 6. In the operating position shown in FIGS. 7 and 8, the actuation device according to the invention is not arrested. The filler-neck flap 28 is situated in a partially open position in which it can be manually pivoted open into the fully open position. Here, the first actuation part 10 together with the filler-neck flap 28 moves away, upward in FIGS. 7 and 8, from the second actuation part 40 which remains fastened to the filler-neck compartment 56.

It is also mentioned that FIG. 8 also shows the locking projections 61 arranged on the free end of the locking legs 60 of the filler-neck compartment 56. It can also be seen in FIG. 8 that the flange 14 of the tappet head 16 is received in an annular groove 23 of the sealing 22. Owing to the elasticity of the sealing 22, the tappet 12 is hereby mounted slightly resiliently in the axial direction.

Figure 9:
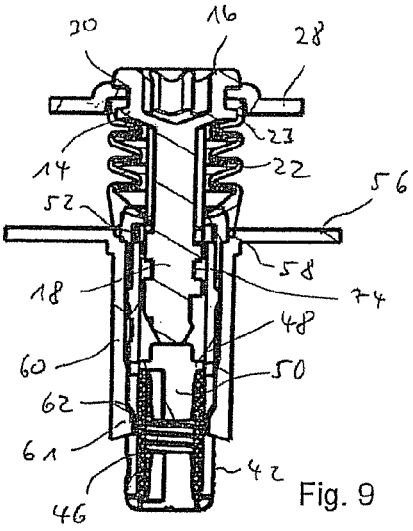
FIG. 9 shows a sectional view of the actuation device from FIG. 7 in a second operating state.

To arrest the actuation device and therefore the filler-neck flap 28 on the filler-neck compartment 56, the filler-neck flap 28 and, together with the latter, the first actuation part 10 are pushed downward from the position shown in FIGS. 7 and 8, such that the first actuation part 10, in particular the tappet 12, performs a substantially axial movement downward. Here, the tappet shank 18 enters into the housing of the second actuation part 40 and in particular passes through the control ring 52. As the tappet shank 18 protrudes into the housing body 42, the bolt 50 is pushed further into the housing body 42 counter to the spring force of the spring 46. Here, the sealing 22 is compressed in the axial direction, as shown in FIG. 9. Furthermore, as the tappet shank 18 enters into the housing body 42, the at least one control projection 54 of the control ring 52 engages into the control curve 20 of the tappet shank 18. After a first predetermined stroke of the tappet 12 into the housing body 42 and a subsequent backstroke of the tappet 12, the tappet 12 is arrested on the control ring 52 in an arresting position. Said arresting position is shown in FIG. 9. In said state, the first actuation part 10 and therefore also the filler-neck flap 28 are arrested on the second actuation part 40 and therefore also on the filler-neck compartment 56. Opening of the filler-neck flap 28 by the exertion of a force in the opening direction of the filler-neck flap 28 (upward in FIG. 9) is thus not possible. In fact, to release the arresting position, the tappet 12 must be pushed further into the housing body 42 with a predefined second stroke. After the release of the arresting position, the tappet 12, and with it the filler-neck flap 28, are driven by the preload of the spring 46 and moved into the position shown in FIG. 8 again, in which the filler-neck flap 28 is partially open and can be manually pivoted open fully.

Figure 10:
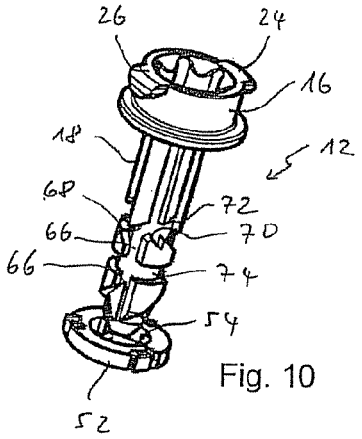
FIG. 10 shows a perspective view of a part of the actuation device from FIG. 7 in a first operating state.
Figure 11:
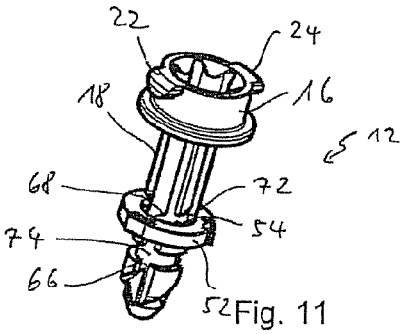
FIG. 11 shows the illustration of FIG. 10, in a second operating state.
Figure 12:
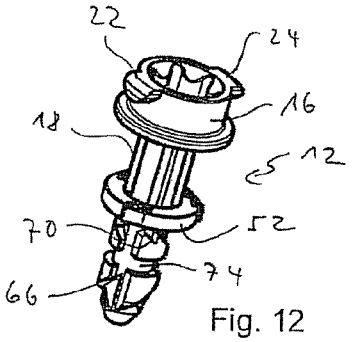
FIG. 12 shows the illustration of FIG. 10, in a third operating state.

The function of the push-push kinematic used in the actuation device according to the invention shall now be explained on the basis of FIGS. 10 to 12. For the sake of clear illustration, only the tappet 12 and the control ring 52 are illustrated in FIGS. 10 to 12. FIG. 10 shows the operating position shown in FIG. 8. At this time, the tappet 12 has not yet entered the control ring 52. It can be seen that the control curve 20 of the tappet shank 18 has a plurality of axially parallel grooves 66. As the tappet shank 18 enters into the control ring 52, the at least one control projection 54 of the control ring 52 passes into an axially parallel groove 66. During the further insertion of the tappet shank 18 into the control ring 52, the control projection 54 correspondingly slides in the axially parallel groove 66, without resulting rotation of the control ring 52. Between the groove 66 and the proximal end, which is the upper end in FIG. 10 and which faces away from the control ring 52, of the tappet 12, there is provided a first deflection surface 68, which runs obliquely with respect to the axis of the tappet 12, of the control curve 20. During the course of the insertion of the tappet shank 18 into the control ring 52, and after the corresponding axial groove 66 has been run through, the deflection surface 68 interacts with the control projection 54 of the control ring 52 such that the control ring 52 is rotated by a predetermined angular value. As viewed in the circumferential direction of the tappet shank 18, a locking reception 70 of the control curve 20 is formed at a distance from the first deflection surface 68 and facing towards the proximal end, which is the upper end in FIG. 10. If the tappet 12 is released after the first predetermined stroke is performed, the tappet is driven by the spring 46 and performs a backstroke out of the housing body 42, wherein the at least one control projection 54 of the control ring 52 is received by the locking reception 70. Said state is shown in FIG. 11. In said position, the tappet 12 cannot be released from the control ring 52, and therefore from the second actuation part 40 and the filler-neck receptacle 56, by the exertion of a force in the opening direction of the flap (upward in FIG. 11). In particular, FIGS. 10 and 11 furthermore show a second deflection surface 72, which runs obliquely with respect to the axis of the tappet 12, of the control curve 20. The second deflection surface 72 is arranged between the locking reception 70 and the proximal end, which is the upper end in FIGS. 10 and 11, of the tappet 12. If the tappet 12 is moved, from the arresting position shown in FIG. 11, further into the control ring 52 with a second stroke, the second deflection surface 72 interacts with the control projection 54 of the control ring 52 such that said control ring is rotated by a predetermined second angular value and the control projection 54 is aligned with a second axial groove 66, such that the tappet 12 can be moved fully out of the control ring 52. The released state of the arresting position can be seen in FIG. 12. In said state, the filler-neck flap 28 can be manually fully opened. The described design of the control cam and the associated push-push kinematic are basically known from DE 10 2008 057 933 A1.

Figure 13:
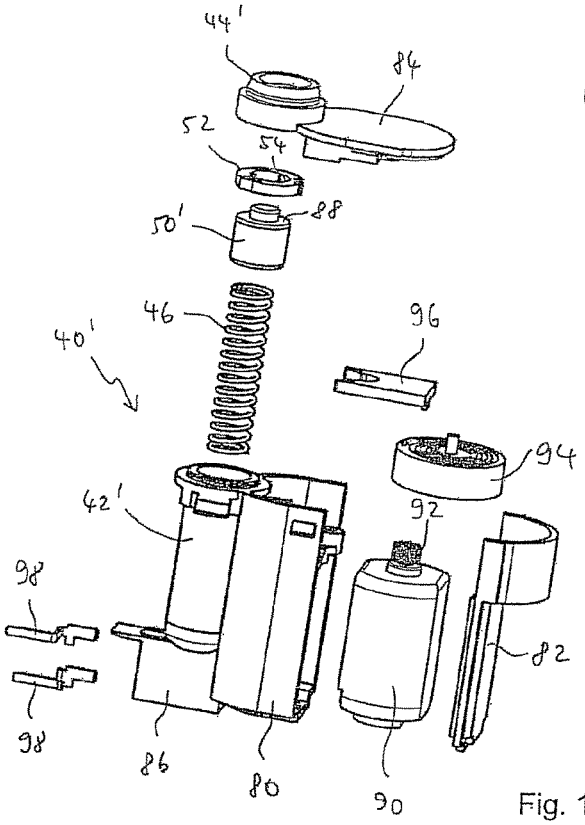
FIG. 13 shows a perspective exploded illustration of a second actuation part of an actuation device according to the invention as per a second exemplar embodiment.
Figure 14:
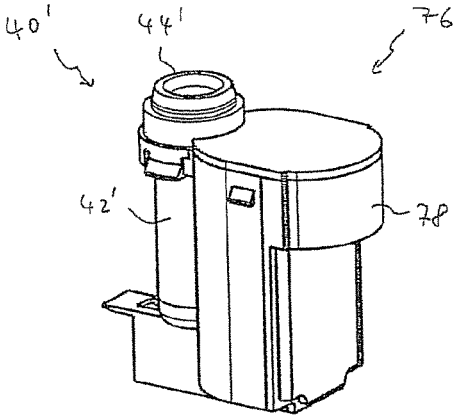
FIG. 14 shows a perspective view of the second actuation part from FIG. 13 in the assembled state.
Figure 15:
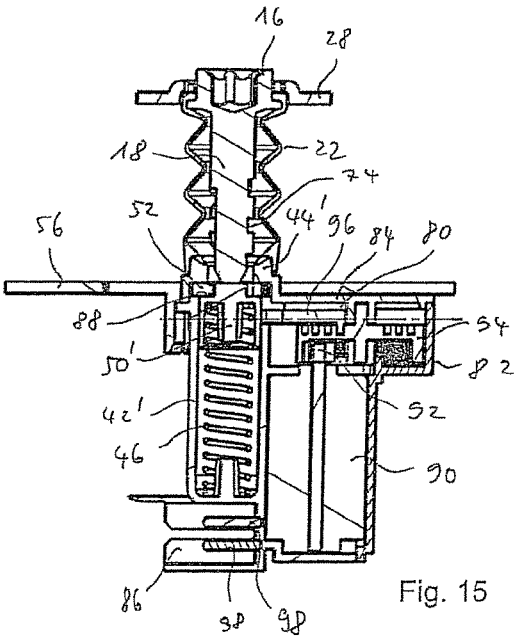
FIG. 15 shows a sectional view of an actuation device according to the invention with the first actuation part from FIGS. 1 to 3 and with the second actuation part from FIGS. 13 and 14 in a first operating state in a sectional view.
Figure 16:
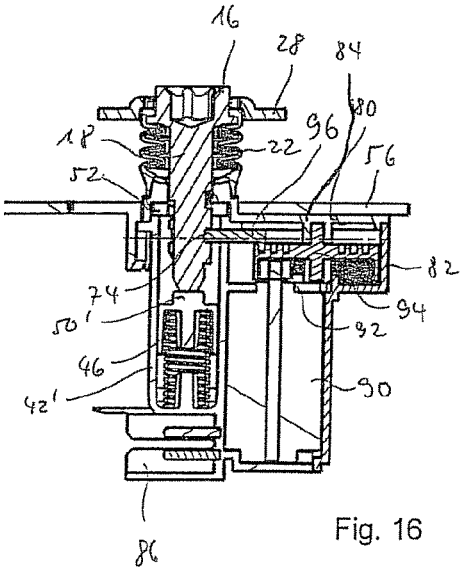
FIG. 16 shows the actuation device from FIG. 15 in a second operating state in a sectional view.

A further exemplary embodiment of an actuation device according to the invention shall now be explained on the basis of FIGS. 13 to 15. FIGS. 13 and 14 show a second actuation part 40 as per a second exemplary embodiment which, together with the first actuation part 10 as per FIGS. 1 to 3, forms an actuation device according to the invention as per a second exemplary embodiment. The second actuation part 40' as per the second exemplary embodiment substantially corresponds in terms of function and design to the second actuation part 40 as per the first exemplary embodiment. In contrast to the first exemplary embodiment, however, in the second exemplary embodiment there are also provided locking means 76 which, in the example illustrated, are operatively connected to a central locking device of the automobile which has the filler-neck flap 28. In particular, the locking means 76 serve to prevent a release of the arresting position of the first and second actuation parts 10, 40 when the vehicle is locked by means of the central locking system. The function of the locking means 76 shall now be explained in more detail on the basis of the exploded illustration of FIG. 13.

In FIG. 13, it can be seen that the housing 78, shown in FIG. 14, of the locking means 76 is constructed from a first housing part 80, a second housing part 82, and a housing cover 84. Here, the housing cover 84 is formed in one piece with the housing cover 44, and the housing part 80 is formed in one piece with the housing body 42' of the second actuation part 40. It can also be seen that a housing base 86 is likewise formed in one piece with the first housing part 80 and the housing body 42. In the same way as the second actuation part 40 as per the first exemplary embodiment explained above, the second actuation part 40' as per the second exemplary embodiment also has a spring 46 and a control ring 52 with at least one control projection 54 formed on the inner circumference. In the assembled state of the second actuation part 40, a bolt 50' is again arranged between the spring 46 and the control ring 52, said bolt however having a step 88 instead of a flange 48 in the second exemplary embodiment. In the assembled state, the control ring 52 is held between the step 88 and the associated inner surface of the housing cover 44. The spring 46 bears against the underside of the bolt 50.

The locking means 76 furthermore comprise an electric drive means 90, in the present case an electric motor. The electric drive means 90 has, on its top side shown in FIG. 13, a gearwheel 92 with an external toothing. In the assembled state, the gearwheel 92 engages into an internal toothing of a drive worm gear 94. If the electric motor is driven, the gearwheel 92 performs a rotational movement which is transmitted via the internal toothing to the worm gear 94. The worm gear 94 is operatively connected to a fork-shaped locking element 96 of the locking means 76. A rotation of the electric motor leads, via the gearwheel 92 and the internal toothing of the drive worm gear 94, to a movement of the locking element 96 radially with respect to the axis of the housing body 42'. The housing body 42' has a cutout which faces toward the first housing part 80 and through which, in the assembled state, the locking element 96 can be moved by the electric drive means 90 selectively into a locking position, in which said locking element projects into the bore of the housing body 42', or into an unlocking position, in which said locking element is retracted from the bore of the housing body 42'.

FIG. 15 shows the actuation device according to the invention as per the second exemplary embodiment, comprising the first actuation part 10 as per FIGS. 1 to 3 and the second actuation part as per FIGS. 13 and 14, in an operating state which corresponds to the operating state of the actuation device according to the invention as per the first exemplary embodiment shown in FIG. 8. In said state, the locking element 96 is in its unlocking position in which it is retracted from the housing body 42', and therefore has no influence on an axial movement of the tappet 12 of the first actuation part 10. In the manner explained above with regard to the first exemplary embodiment in FIGS. 8 and 9, the tappet 12 can be pushed with the predetermined first stroke into the housing body 42' from the position shown in FIG. 15. The tappet 12 subsequently again performs a return stroke, driven by the spring 46, and is arrested in the arresting position shown in FIG. 16. The function of the push-push kinematic corresponds to the function explained above with regard to FIGS. 1 to 12. The tappet 12 and therefore the first actuation part 10 can now be locked in the arresting position shown in FIG. 16 by the locking means 76. For this purpose, in the operating state shown in FIG. 16, the locking element 96 is moved into its locking position. The arrangement of the locking element 96 in the assembled state is precisely such that the locking element 96 engages into the circumferential groove 74 of the tappet 12 or of the shank 18 thereof when the tappet 12 is situated in the arresting position shown in FIG. 16. The locking element 96 then prevents an axial movement of the tappet 12. In the locking position of the locking element 96, the first actuation part 10 thus cannot be released from the arresting position. Correspondingly, in the locking position 96, the filler-neck flap 28 also cannot be opened.

It is also mentioned that the locking means 76 furthermore comprises manual unlocking means in the form of straps 98 which permit manual unlocking of the locking means 76, for example if a battery of the automobile has been completely discharged.

It is also mentioned that, aside from the described exemplary embodiment of a filler-neck flap pivotably mounted on a filler-neck compartment of an automobile, other applications for the actuation device according to the invention are also conceivable, as explained in the introduction. Furthermore, it is mentioned that it is also possible for the second actuation parts 40, 40' to be fastened on the flap and for the first actuation part 10 to be fastened on the component.

The invention claimed is:

1. A latch device for a flap pivotably mounted on a compartment of an automobile so as to be movable between a closed position and an opened position with a push-push kinematic, the latch device comprising a first actuation part and a second actuation part, wherein the first actuation part is to be fastened on the flap and is moved in an axial direction when the flap is moved between the closed position and the opened position, and wherein the second actuation part is to be fastened on the component, wherein the first actuation part engages with the second actuation part when the flap is moved from its opened position into its closed position, so that after a predetermined first stroke of the first actuation part in the direction of the second actuation part and a subsequent backstroke of the first actuation part, the actuation parts are held on each other in an arresting position, and wherein the arresting position is released by a predetermined second stroke of the first actuation part in the direction of the second actuation part so that the flap can be moved into its opened position, wherein the first actuation part and the second actuation part are disengaged, wherein one of the first or second actuation parts comprises a tappet with a control curve on its outer circumference and the other of the first or second actuation parts comprises a housing and a control ring mounted in the housing so as to be axially fixed and rotatable in the housing, wherein the control ring comprises at least one control projection on its inner circumference, wherein the tappet enters the control ring when the flap is moved from its opened position to its closed position, wherein the at least one control projection of the control ring engages with the control curve of the tappet so that after the predetermined first stroke and the subsequent backstroke, the tappet is held in the arresting position on the control ring, and wherein the tappet is released from the arresting position on the control ring by the predetermined second stroke, so that the flap can be moved into its opened position, wherein the tappet exits the control ring, so that the at least one control projection of the control ring and the control curve of the tappet disengage, and wherein the control curve of the tappet comprises:

at least one axially parallel groove on an outside of the tappet, wherein the at least one control projection of the control ring is engageable with the at least one groove over a large axial adjusting range of the tappet, whereby the control ring keeps its rotational position in the area of the at least one groove when the tappet is moved axially, a first deflection surface between the at least one groove and a proximal end of the tappet, wherein the first deflection surface faces away from the control ring before the tappet enters the control ring, and is inclined relative to an axis of the tappet, and wherein the first deflection surface engages with the at least one control projection of the control ring and rotates the control ring about a predetermined angular value when the tappet is moved into the control ring with the predetermined first stroke, a locking reception, in a circumferential distance to the first deflection surface, faces-towards the proximal end of the tappet, wherein the locking reception receives the at least one control projection]when the tappet carries out the subsequent backstroke, whereby the tappet is held in the arresting position in the control ring after the subsequent backstroke, a second deflection surface between the locking reception and the proximal end of the tappet that is inclined to the axis of the tappet, wherein the second deflection surface engages with the at least one control projection when the tappet is moved further into the control ring by the predetermined second stroke, whereby the control ring is rotated by a predetermined second angular value and the at least one control projection is aligned with a second axial groove and the tappet is moveable into a maximum extended position.

2. The latch device as claimed in claim 1, further comprising a spring unit preloaded by the first actuation part upon the predetermined first stroke, wherein the spring unit automatically effects the subsequent backstroke of the first actuation part.

3. The latch device as claimed in claim 1, wherein the first actuation part comprises the tappet and, the second actuation part comprises the housing and the control ring mounted in the housing so as to be axially fixed and rotatable in the housing.

4. The latch device as claimed in claim 1, wherein the first actuation part comprises the housing and the control ring mounted in the housing so as to be axially fixed and rotatable in the housing and, in that the second actuation part comprises the tappet.

5. The latch device as claimed in claim 1, wherein the tappet is surrounded on its circumference by a sealing.

6. The latch device as claimed in claim 5, wherein the sealing is a bellows.

7. The latch device as claimed in claim 5, wherein the tappet is elastically mounted on the sealing in an axial direction.

8. The latch device as claimed in claim 1, further comprising a locking unit which has a locking state and an unlocking state, wherein in the locking state, releasing of the arresting position of the actuation parts is not possible and wherein in the unlocking state, releasing of the arresting position of the actuation parts is possible.

9. The latch device as claimed in claim 8, wherein the locking unit is actuated between the locking state and the unlocking state by a central locking device of an automobile.

10. The latch device as claimed in claim 8, wherein in the locking state, the locking unit impedes the predetermined second stroke of the first actuation part.

11. The latch device as claimed in claim 10, wherein the locking unit comprises a drive element and at least one locking element which is moveable by the drive element in a radial direction with respect to the axial moving direction of the first actuation part between a locking position, and an unlocking position, wherein in the locking position the locking element engages with the first actuation part or with the second actuation part and thus impedes the predetermined second stroke of the first actuation part.

12. The latch device as claimed in claim 11, wherein the first-actuation part comprises a reception, and when in the locking position, the locking element engages the reception, and in the unlocking position, the locking element is retracted from the reception.

13. The latch device as claimed in claim 12, wherein the reception is provided on the outer circumference of the tappet.

14. The latch device as claimed in claim 13, wherein the reception is a reception groove.

15. A latch device for a flap pivotably mounted on a compartment of an automobile so as to be movable between a closed position and an opened position with a push-push kinematic, the latch device comprising a first actuation part and a second actuation part, wherein the first actuation part is to be fastened on the flap and is moved in an axial direction when the flap is moved between the closed position and the opened position, and wherein the second actuation part is to be fastened on the component, wherein the first actuation part engages with the second actuation part when the flap is moved from its opened position into its closed position, so that after a predetermined first stroke of the first actuation part in the direction of the second actuation part and a subsequent backstroke of the first actuation part, the actuation parts are held on each other in an arresting position, and wherein the arresting position is released by a predetermined second stroke of the first actuation part in the direction of the second actuation part so that the flap can be moved into its opened position, wherein the first actuation part and the second actuation part are disengaged, wherein one of the first or second actuation parts comprises a tappet with a control curve on its outer circumference and the other of the first or second actuation parts comprises a housing and a control ring mounted in the housing so as to be axially fixed and rotatable in the housing, wherein the control ring comprises at least one control projection on its inner circumference, wherein the tappet enters the control ring when the flap is moved from its opened position to its closed position, wherein the at least one control projection of the control ring engages with the control curve of the tappet so that after the predetermined first stroke and the subsequent backstroke, the tappet is held in the arresting position on the control ring, and wherein the tappet is released from the arresting position on the control ring by the predetermined second stroke, so that the flap can be moved into its opened position, wherein the tappet exits the control ring, so that the at least one control projection of the control ring and the control curve of the tappet disengage, and wherein the actuation part comprising the control ring further comprises a bolt which is axially mounted so as to be movable in the housing of the one of the first or second actuation parts and which is preloaded by a spring in the direction of the control ring, wherein the tappet of the other one of the first or second actuation parts pushes the bolt against the spring upon the predetermined first stroke and preloads the same thereby such that the spring automatically effects the subsequent backstroke of the first actuation part.

16. The latch device as claimed in claim 15, wherein the first actuation part can be fastened on the flap by a locking connection or a bayonet connection and/or the second actuation part can be fastened on the component by a locking connection or a bayonet connection.

17. A compartment of an automobile with the flap pivotably mounted on the compartment, comprising a latch device according to claim 15.

* * * * *